US007182159B2

(12) United States Patent
Linden

(10) Patent No.: US 7,182,159 B2
(45) Date of Patent: Feb. 27, 2007

(54) DRILL MEMBER FOR ROCK DRILLING AND A METHOD FOR MANUFACTURING THE DRILL MEMBER

(75) Inventor: Johan Linden, Gävle (SE)

(73) Assignee: Sandvik Intellectual Property AB, Sandviken (SE)

( * ) Notice: Subject to any disclaimer, the term of this patent is extended or adjusted under 35 U.S.C. 154(b) by 332 days.

(21) Appl. No.: 10/505,152

(22) PCT Filed: Feb. 18, 2003

(86) PCT No.: PCT/SE03/00260

§ 371 (c)(1),
(2), (4) Date: Oct. 19, 2004

(87) PCT Pub. No.: WO03/071088

PCT Pub. Date: Aug. 28, 2003

(65) Prior Publication Data

US 2005/0067195 A1 Mar. 31, 2005

(30) Foreign Application Priority Data

Feb. 21, 2002 (SE) ..... 0200505

(51) Int. Cl.
*E21B 17/20* (2006.01)
*B21D 39/00* (2006.01)

(52) U.S. Cl. ..... 175/320; 411/900; 29/525.14; 76/108.2

(58) Field of Classification Search ..... 175/320; 76/108.2; 29/525.14, 557; 411/900, 901, 411/902, 914; 72/258
See application file for complete search history.

(56) References Cited

U.S. PATENT DOCUMENTS

| | | | | |
|---|---|---|---|---|
| 4,366,971 | A * | 1/1983 | Lula | 285/55 |
| 5,056,209 | A * | 10/1991 | Ohashi et al. | 29/517 |
| RE33,901 | E * | 4/1992 | Shinjo | 411/387.1 |
| 5,940,951 | A * | 8/1999 | Schulz et al. | 29/421.1 |
| 6,394,190 | B2 * | 5/2002 | Linden | 173/1 |
| 6,681,875 | B2 | 1/2004 | Larsson et al. | |
| 6,874,986 | B2 * | 4/2005 | Koppel et al. | 411/386 |

FOREIGN PATENT DOCUMENTS

WO WO 92/107730 10/1992

* cited by examiner

*Primary Examiner*—William Neuder
(74) *Attorney, Agent, or Firm*—Drinker Biddle & Reath LLP

(57) ABSTRACT

A drill member for percussive rock drilling is formed by forming a compound component and friction welding the compound component to the end of a drill rod. The compound component is formed by welding a core part within a shell part and machining a thread into either the shell part (male thread) or core part (female thread). The part in which the thread is machined is formed of low alloy steel, and the other part is formed of stainless steel, wherein the thread bottom is formed of stainless steel, and the thread crests are formed of low alloy steel.

20 Claims, 4 Drawing Sheets

DRILL MEMBER FOR ROCK DRILLING AND A METHOD FOR MANUFACTURING THE DRILL MEMBER

BACKGROUND OF INVENTION

The present invention relates to a drill member for rock drilling and a method for manufacturing such a drill member.

RELATED ART

During percussive top hammer drilling in rock a drill string is intended to be fastened to a shank adapter in a drilling machine via one end surface of a rod or a tube. The other end of the rod or the tube is threaded either to another rod or another tube or a drill bit for percussive drilling. The rod or the tube can also be fastened to the shank adapter or another part with the aid of threaded sleeves. A flush channel runs through the entire drill string in order to lead flush medium to the drill bit for flushing away drill cuttings.

During the drilling, the drill string members, i.e. bits, rods, tubes, sleeves and shank adapters, are subjected to corrosive attacks. This applies especially at drilling below earth where water is used as flush medium and where the environment is moist. Corrosive attacks are especially serious at the most stressed parts, i.e. at thread bottoms and other wall thickness reductions. The corrosion, in combination with pulsating strain, caused by impact waves and bending stresses, results in so-called corrosion fatigue. This is a usual cause for breakage of the drill string.

Generally, a low alloyed case hardened steel is used in the drill member. The reason for this is that abrasion and wear of the thread portions have traditionally been the main cause of limiting the life spans. As the drilling machines and the drill members become better, though, these problems have diminished and corrosion fatigue has become a limiting factor.

The case hardening produces compressive stresses in the surface, which give a certain beneficial effect against the mechanical part of the fatigue. Corrosion resistance of low alloyed steel is however poor and for that reason corrosion fatigue still occurs easily, and so breakages often occur.

In U.S. Pat. No. 4,872,515 or U.S. Pat. No. 5,064,004 a drill member is shown where a threaded portion has been covered with a metallic material, which is softer than the steel of the drill member. That is intended to solve the problem of frictional damage (pitting) in the threads by covering at least the parts of the thread of the drill member that cooperate with other parts of the threaded connection.

One method of eliminating corrosion fatigue is to make the rods of stainless steel such as in SE-A-0000521-5. The stainless steel is however relatively soft and consequently has inferior wear resistance than a carburized rod, i.e. it wears out relatively quickly.

Through SE-C2-515 195 and SE-C2-515 294 thread joints for percussive rock drilling are shown. By covering the thread bottoms of the cylindrical external thread with at least one layer of a material having an electrode potential different from that of the underlying steel, an increased tool life for the threaded connection is attained.

OBJECTS OF THE INVENTION

One object of the present invention is to considerably improve the resistance to corrosion fatigue in a drill member for percussive rock drilling.

Another object of the present invention is to considerably improve the resistance to corrosion fatigue at sections with reduced thickness of the material in a drill member for percussive rock drilling.

Still another object of the present invention is to considerably improve the resistance to corrosion fatigue in thread bottoms in a threaded portion in a drill member for percussive rock drilling.

Still another object of the present invention is to provide a method for manufacturing a drill member with improved resistance against corrosion fatigue for percussive rock drilling.

SUMMARY OF INVENTION

These and other objects have been achieved by a percussive rock drilling member comprising at least one thread. The thread includes thread crests and thread bottoms. The thread crests comprise low alloy steel, and the thread bottoms comprise stainless steel. A flush channel extends through the rock drilling member.

Another aspect of the invention relates to a drill rod which comprises a main portion and two end members welded to respective ends of the main portion. Each end member comprises a thread formed as described above.

A further aspect of the invention relates to a method for manufacturing a percussive rock drilling member which comprises the steps of:

A) providing a shell and a core, one of the shell and the core comprising stainless steel, and the other of the shell and the core comprising low alloy steel;

B) fitting the core into the shell with close fit to form a blank;

C) welding the ends of the shell and the core to each other;

D) extruding the blank to form a compound component; and

E) machining a thread in the compound component, wherein the thread bottoms comprise stainless steel and the thread crests comprise low alloy steel.

BRIEF DESCRIPTION OF THE DRAWINGS

A preferred embodiment of the invention is described in detail blow, with reference to the appended drawings.

DESCRIPTION OF A PREFERRED EMBODIMENT OF THE INVENTION

The invention relates to a drill member for rock drilling and a method for manufacturing a drill member with a flush channel for percussive drilling with at least one reduction or a portion 40, 40' with relatively thin thickness of the material, which is performed of homogenous stainless steel in order to considerably improve the resistance against corrosion fatigue. In addition, the flush channel is in one case performed in the same stainless steel and therefore corrosion fatigue therein no longer occurs during rock drilling.

According to the invention a drill member is provided for percussive drilling, that is, a male portion 19 (FIG. 5A) or a female portion 26 (FIG. 7) equipped with an external thread 16 and an internal thread 16', respectively. The threads shown are so 30 called cylindrical trapezoidal threads but other thread shapes may be used, for example conical threads or rope threads or a combination of these.

Figure 5A:
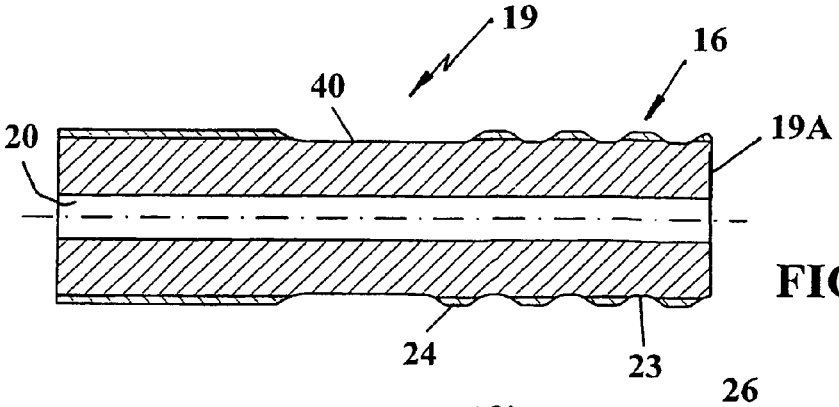
FIG. 5A shows an axial cross-section of a mate portion according to the present 10 invention after machining of the part according to FIG. 4.
Figure 5C:
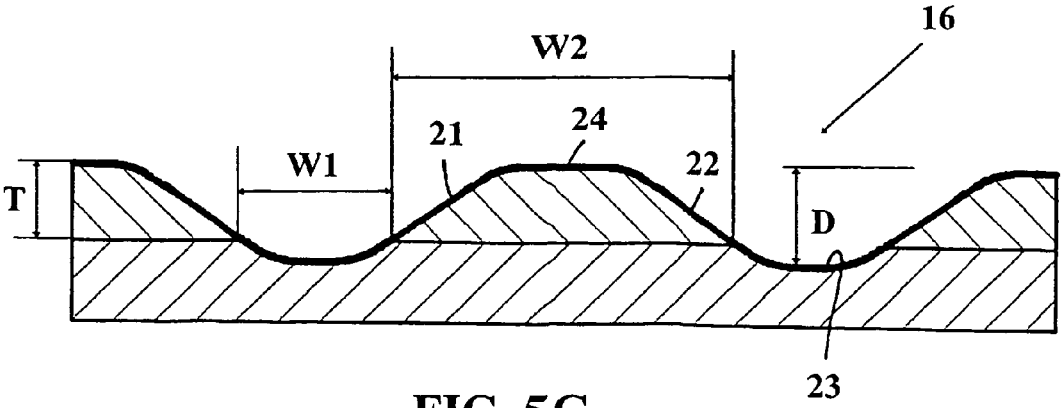
FIG. 5C shows an enlarged sectional view of the thread in FIG. 5A.

With reference mainly to FIGS. 5A and 5C the drill member 19 has a through flush channel 20, through which a flush medium, generally air or water, is led. The thread 16 comprises thread bottoms 23 and thread crests 24, with thread flanks 21, 22 provided therebetween. The thread bottoms 23 are formed of stainless steel and the thread crests 24 of low alloyed steel.

The thread 16 has a depth D, which is defined as the perpendicular distance between the thread bottom 23 and the thread crest 24 and the low alloyed portion of the thread crest 18 has a thickness T after machining. The depth D is generally in the range of 14 mm and the outer diameter of the rod is 20–70 mm. The ratio T/d is 0.1–1.0, preferably 0.4–0.8. In a preferred embodiment a trapezoidal thread (T38) with a depth D=2–2.5 mm and a shell 18 with a thickness T of 1–2 mm, preferably around 1.5 mm, is used.

Figure 5B:
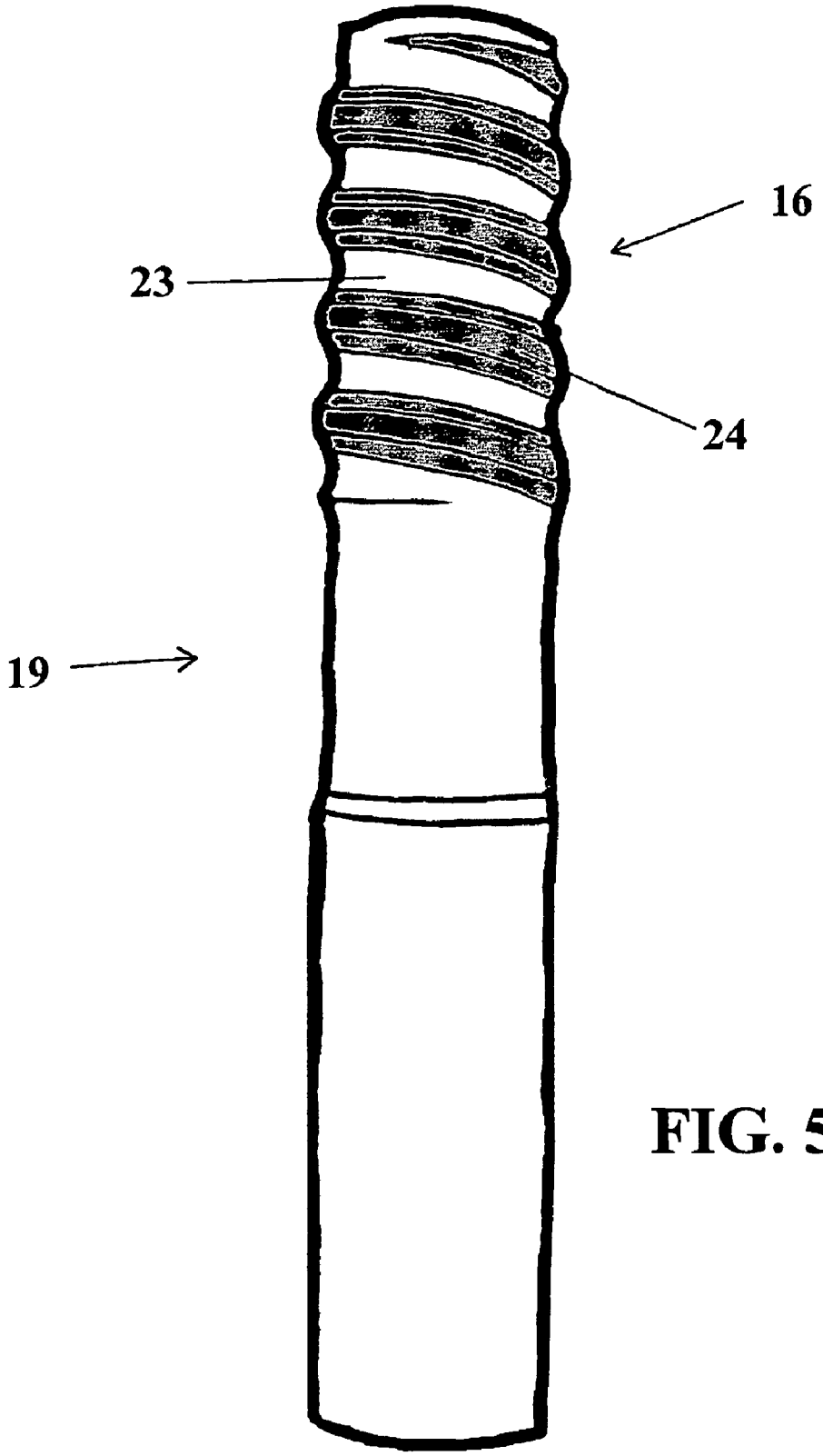
FIG. 5B shows a photo of the portion in FIG. 5A.

The thread bottom 23 and the stainless steel portion of the thread flanks 21, 22 have a first width W1, and the thread crest 24 and the low alloyed portion of the thread flanks 21, 22 have a second width W2 (FIG. 5C), where the ratio W1/W2 is 0–0.9, preferably 0.3–0.8. The widths W1 and W2 of the thread bottom 23 and the thread crest 24 respectively, can be defined as the largest length of the respective material in the longitudinal direction of the member exposed towards the surroundings. A male portion according to the present invention according to FIG. 5B with a trapezoidal thread (T38) is characterized in that W1=6.1 mm, and W2=9.5 mm, and ratio W1/W2=0.64.

By making the thread bottoms 23 of stainless steel, the male portion 19 has great resistance against corrosion fatigue. The stainless steel has a composition which gives a PRE value>10, preferably 12–17. PRE means Pitting Resistance Equivalent and describes the resistance of the alloy against pitting. PRE is defined according to formula $$PRE=Cr+3.3(Mo+W)+1\ 6N$$

where Cr, Mo, W and N corresponds to the contents of the members in weight percent.

That low alloyed steel in the shell 18 has a hardness>500 Vickers, most 30 preferably 650–800 Vickers whereby good wear resistance will be obtained. The hardness can be obtained by making the component in tough hardened steel, by carburizing the surface or by induction surface hardening. The low alloyed steel preferably has a composition in weight %

| | |
|---|---|
| C | 0.1–0.7 |
| Si | 0.1–1 |
| Mn | 0.2–2 |
| Cr | <5 |
| Ni | <5 |
| Mo | <2 |

the rest being Fe and normal impurities.

Figure 1A:
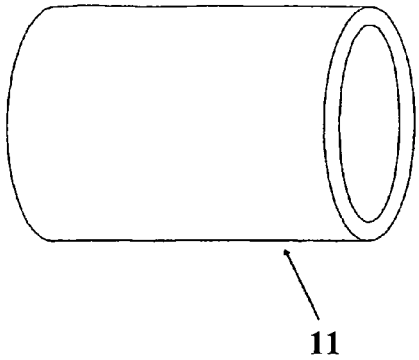
FIG. 1A shows a tube and FIG. 1B shows a rod, both in perspective views.
Figure 1B:
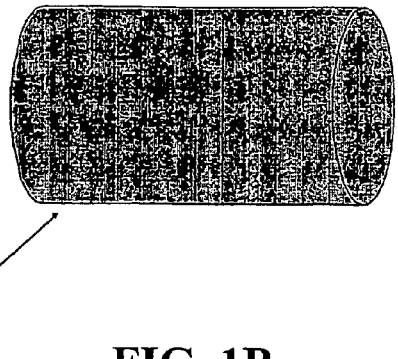
Figure 2:
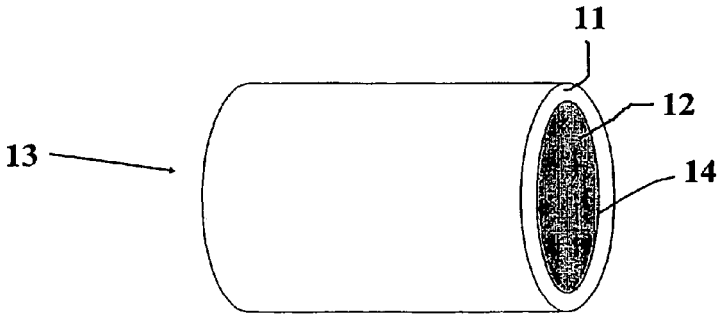
FIG. 2 shows a blank for extrusion in a perspective view.
Figure 3:
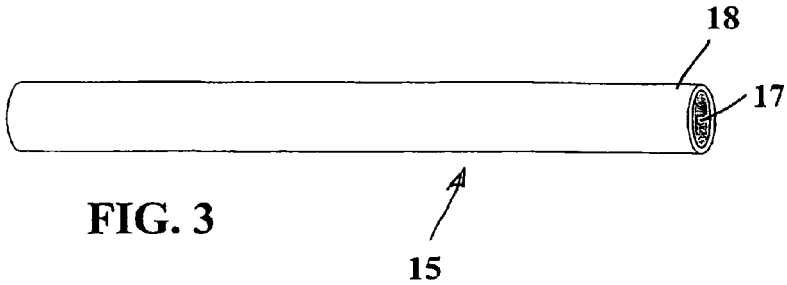
FIG. 3 shows an extruded rod in a perspective view.

Male portions or drill members according to the invention are made as follows:

In FIG. 1A a tube 11 is shown, and in FIG. 1B a solid rod 12 is shown. The tube 11 and the rod 12 are fitted with fine tolerances, for example by shrink fit, into each other to form a blank 13 such as is apparent from FIG. 2 and are fixed by circumferential welds 14 at the ends of the blank. In addition the welds 14 give a protection against oxidation at the interface between the tube 11 and the rod 12 during the subsequent heating. The blank 13 is extruded in hot condition to a compound component 15 rod with diameter that is adapted to the desired dimension of a thread 16 for percussive rock drilling (see FIG. 5A). By "compound component" is here meant an extruded tube or an extruded rod of at least two different materials.

Figure 6:
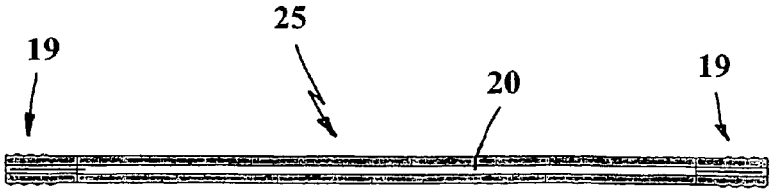
FIG. 6 shows a drill rod according to the present invention in a side view.
Figure 4:
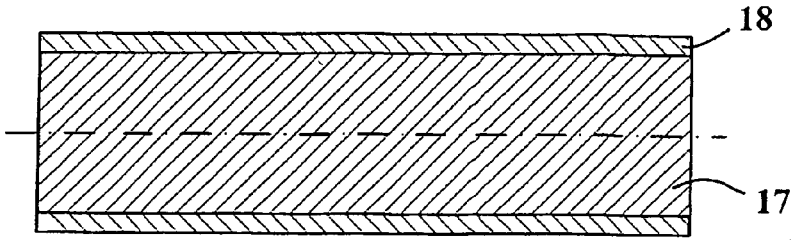
FIG. 4 shows an axial cross-section of a part machined from the rod in FIG. 3.
Figure 7:
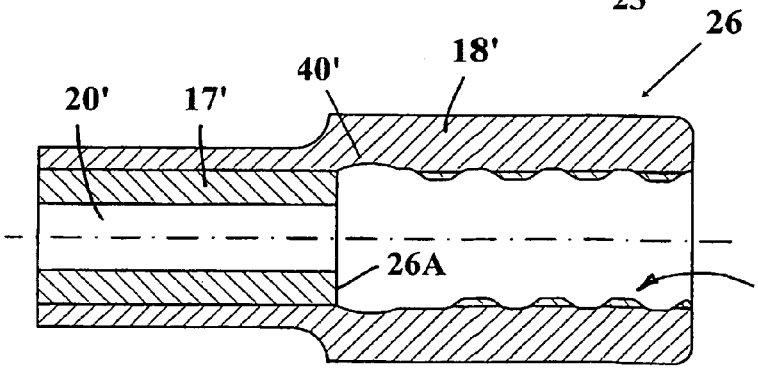
FIG. 7 shows an axial cross-section of a female portion according to the present invention.

The compound component in the shown embodiment comprises a rod 15 with a core 17 of stainless steel and a shell 18 of low alloyed steel. From this rod a conventional external thread or male thread for percussive rock drilling 16 is turned, such that thread bottoms are obtained in the stainless core 17. Alternatively, the core 17' comprises low alloyed steel and the shell 18' of stainless steel (FIG. 7). From this rod a conventional inner thread or female thread 16' for percussive rock drilling is turned, such that thread bottoms are obtained in the stainless portion 18'. The overall thread 16, 16' consequently shall comprise at least two different materials. The machined ends are carburized in order to give hardness and wear resistance to the flanks of the thread 16, 16'. Coating these portions in order to avoid carburization thereof protects the stainless steel. The machined ends are then friction welded to a hexagonal rod or to a round rod of low alloyed or stainless steel, e.g., to a drill rod 25 (FIG. 6) which finally is hardened and annealed to form a drill member. A central flush channel 20 is drilled through the member.

Alternatively, a hollow tube can be used in place of the solid rod 12 such that the finished extruded compound component 15 comprises a hollow tube such that one doesn't have to drill a hole. In the latter case, the extrusion blank 13 shall have a hole for a mandrel and therefore the rod that will constitute the core instead may be a tube blank or a solid rod that is drilled.

Both the male portion 19 and the female portion 26 comprise impact transferring surfaces oriented transversely to the center axis, that is, the end surface 19A and the bottom surface 26A, respectively.

EXAMPLE

Figure 5D:
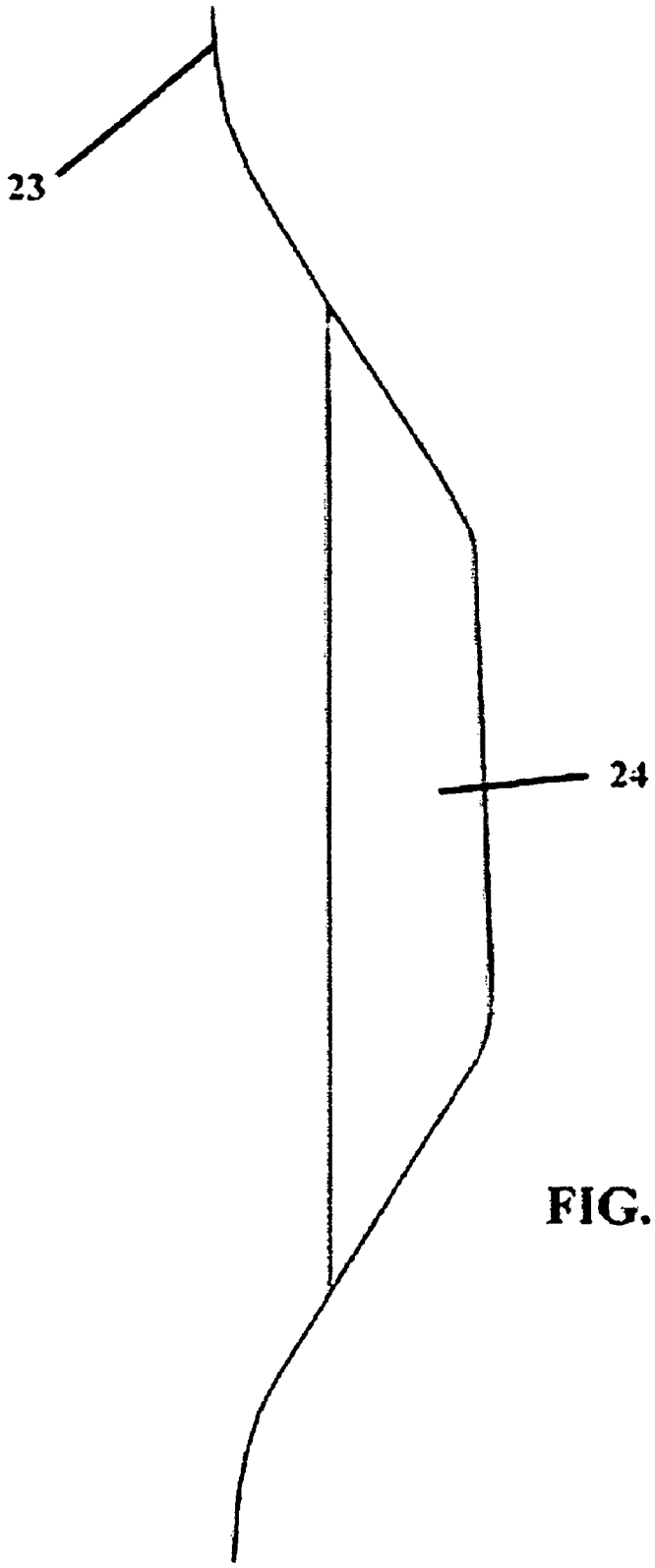
FIG. 5D shows a photo of an about 10 times enlarged sectional view of the thread in FIG. 5B.

Extrusion blanks 13 were manufactured from tubes 11 of low alloyed steel, with composition no. 1 (see chart below) having an outer diameter of 77 mm and inner diameter of 63 mm, and stainless rods 12, with composition no. 2 and a diameter 63 mm. The blanks were heated to 1150° C. and were extruded into rods 15 with outer diameter of 43 mm. The diameter for the stainless steel was 35 mm. Investigations in light microscope showed that the metallurgical bond between the low alloyed steel and the stainless steel was good, see FIG. 5D. From the rods obtained through this procedure, male portions 19 were manufactured by means of conventional machining. The thread was of the type T38 with outer diameter 38 mm and depth of 2.35 mm. These were then case hardened, during which the exposed surfaces of stainless steel were covered by a protective coating for avoiding effects of the carbon containing gaseous atmosphere. The male portions were then friction welded to respective ends of a rolled rod 25, which included a flush channel. The male portions had a composition no. 3. Subsequently a flush channel was drilled in each male portion and all rods were hardened to 1030° C.

| | % C | % Si | % Mn | % Cr | % Ni | % Mo | % Fe |
|---|---|---|---|---|---|---|---|
| 1 | 0.22 | 0.21 | 0.57 | 1.26 | 2.62 | 0.22 | rest |
| 2 | 0.21 | 0.61 | 0.46 | 12.9 | 0.11 | 0.02 | rest |
| 3 | 0.19 | 0.27 | 0.45 | 13.3 | 0.29 | 0.02 | rest |

Five finished rods were put into in a rig for so called drifter drilling below earth and were drilled until fracture/wearing-out occurred. The following life spans, measured in so-called drilled meter, were obtained:

| | |
|---|---|
| Rod 1 | 7200 m |
| Rod 2 | 6223 m |
| Rod 3 | 6888 m |
| Rod 4 | 8901 m |
| Rod 5 | 6054 m |

Normal tool life for standard drill tubes, that is case hardened low alloyed steel of the same type as the shell 18, is about 5000 m, which shows that the drill member according to the present invention exhibited a sharp increase in tool life.

The invention relates primarily to drifter rods, i.e. rods with male portions at both ends. One can however imagine also making drill tubes or MF (Male/Female) rods by the method according to the present invention. An MF rod has both male and female portions.

In an alternative embodiment the entire thread may be formed of in low alloyed steel wherein the stainless steel does not reach the bottom of the thread in the radial direction. In this way the stainless steel retards corrosion fatigue when the low alloyed steel is broken through by corrosion induced cracks.

The invention claimed is:

1. A percussive rock drilling member comprising at least one thread, the thread including thread crests and thread bottoms, the thread crests comprising low alloy steel, and the thread bottoms comprising stainless steel; a flush channel extending through the rock drilling member.

2. The percussive rock drilling member according to claim 1 wherein the portion of the thread crests formed of low alloy steel having a thickness T, and the thread having a depth D, wherein $0.1<T/D<1.0$.

3. The percussive rock drilling member according to claim 1 wherein $0.4<T/D<0.8$.

4. The percussive rock drilling member according to claim 2, wherein D is in the range of 1–4 mm, and T is 1–2 mm.

5. The percussive rock drilling member according to claim 4 wherein T is substantially 1.5 mm.

6. The percussive rock drilling member according to claim 2 wherein the thread bottom has a first width W1, and the thread crest has a second width W2, wherein W1/W2 is in the range of 0–0.9.

7. The percussive rock drilling member according to claim 6 wherein W1/W2 is in the range 0.3–0.8.

8. The percussive rock drilling member according to claim 1 wherein the stainless steel comprises a composition having a PRE value greater than 10, and the low alloy steel has a hardness greater than 500 Vickers.

9. The percussive rock drilling member according to claim 8 wherein the PRE value is in the range 12–17, and the hardness is in the range 650–800 Vickers.

10. The percussive rock drilling member according to claim 8 wherein the low alloy steel comprises:

C=0.1–0.7 weight percent

Si=0.1–1 weight percent

Mn=0.2–2 weight percent

Cr=<5 weight percent

Ni=<5 weight percent

Mo=<2 weight percent the remainder comprising Fe and normal impurities.

11. The percussive rock drilling member according to claim 1, comprising a core and a shell, wherein one of the core and shell comprises stainless steel, and the other of the core and the shell comprises low alloy steel.

12. The percussive rock drilling member according to claim 11 wherein the core comprises stainless steel and the shell comprises low alloy steel, the rock drilling member being externally threaded.

13. The percussive rock drilling member according to claim 11 wherein the core comprises low alloy steel and the shell comprises stainless steel, the rock drilling member being internally threaded.

14. The percussive rock drilling member according to claim 1 wherein the at least one thread is provided on a compound component welded on an end of a drill rod.

15. A drill rod comprising a main portion and two end members welded to respective ends of the main portion, each end member comprising a thread including thread crests and thread bottoms, the thread crests comprising low alloy steel, and the thread bottoms comprising stainless steel, and a flushing channel extending through the main portion and the end members.

16. The drill rod according to claim 15 wherein the main portion comprises stainless steel.

17. The drill rod according to claim 15 wherein the main portion comprises low alloy steel.

18. A method for manufacturing a percussive rock drilling member comprising the steps of:

A) providing a shell and a core, one of the shell and the core comprising stainless steel, and the other of the shell and the core comprising low alloy steel;

B) fitting the core into the shell with close fit to form therewith a blank;

C) welding the ends of the shell and the core to each other;

D) extruding the blank to form a compound component; and

E) machining a thread in the compound component, wherein the thread bottoms comprise stainless steel and the thread crests comprise low alloy steel.

19. The method according to claim 18 further comprising friction welding the compound component to a drill rod.

20. The method according to claim 18 further comprising forming a flushing channel through the member.

* * * * *